US006394672B1

(12) United States Patent
Murray et al.

(10) Patent No.: US 6,394,672 B1
(45) Date of Patent: May 28, 2002

(54) IMAGING APPARATUS HAVING A BIASED PLATEN

(75) Inventors: David Kyle Murray; Mark Alan Wahl, both of Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/616,602

(22) Filed: Jul. 14, 2000

(51) Int. Cl.[7] ..... B41J 11/20

(52) U.S. Cl. ..... 400/58; 400/55; 400/649; 400/655; 400/656; 400/691; 347/8

(58) Field of Search ..... 347/8; 400/56, 400/55, 58, 649, 653, 655, 656, 657, 658, 691, 693

(56) References Cited

U.S. PATENT DOCUMENTS

| | | | | |
|---|---|---|---|---|
| 3,384,216 A | | 5/1968 | Thayer | |
| 4,616,944 A | * | 10/1986 | Galatha et al. | 400/692 |
| 4,836,696 A | | 6/1989 | Okumura et al. | |
| 5,195,836 A | | 3/1993 | Longust et al. | |
| 5,414,453 A | | 5/1995 | Rhoads et al. | |
| 5,879,091 A | * | 3/1999 | De Ambrogio | 400/656 |
| 5,940,092 A | * | 8/1999 | Kashimura et al. | 347/8 |
| 6,036,380 A | | 3/2000 | Astroth et al. | |
| 6,171,001 B1 | * | 1/2001 | Nonaka | 400/58 |

* cited by examiner

*Primary Examiner*—Andrew H. Hirshfeld
*Assistant Examiner*—Kevin D. Williams
(74) *Attorney, Agent, or Firm*—Taylor & Aust, P.C.

(57) ABSTRACT

An imaging apparatus provides a machine frame including a first side frame and a second side frame. A first plurality of platen mounting members is provided which are spaced apart and extend from the first side frame. A second plurality of platen mounting members is provided which are spaced apart and extend from the second side frame. A platen is positioned to extend between the first side frame and the second side frame. The platen has a first end including a first plurality of engagement members and has a second end including a second plurality of engagement members. A biasing assembly is coupled to the machine frame, wherein the biasing assembly applies a biasing force to the platen to move the first plurality of engagement members into respective engagement with the first plurality of platen mounting members and to move the second plurality of engagement members into respective engagement with the second plurality of platen mounting members.

20 Claims, 8 Drawing Sheets

IMAGING APPARATUS HAVING A BIASED PLATEN

BACKGROUND OF THE INVENTION

1. Field of the Invention

The present invention relates to an imaging apparatus, and, more particularly, to an ink jet printer having a biased platen.

2. Description of the Related Art

Some imaging apparatus, such as a typical ink jet printer, have a reciprocating printhead whereby a printhead carriage carrying the printhead is supported by a pair of carrier guide rods which are positioned substantially traverse to a print media path. As a sheet of print media is transported in an indexed manner under the printhead, the printhead is scanned in a reciprocating manner across the width of an image area on the sheet of print media, wherein the path of the reciprocating printhead defines a print zone. A platen is provided opposite to the printhead for contacting the non-printed side of the print media and, in part, defines the distance between the printhead and the sheet of print media.

It has been realized that the distance between the plane of the nozzle plate of the printhead and the plane of the print media on which the ink expelled from the nozzle plate is deposited, also known as the printhead to print media gap, can have an impact on the print quality of the ink jet printer. As the gap deviates from the ideal gap, and particularly as a result of a widened gap, an error in dot placement increases. The limits on the low end of the gap range is defined by the point at which the printhead actually contacts the media, thereby causing smearing of the freshly deposited ink. In addition, such contact with the print media can result in damage to the printhead such as, for example, by clogging the nozzles of the nozzle plate of the printhead. Thus, it is desirable in a high quality ink jet printer design to control the printhead to print media gap to a minimum value without permitting contact between the printhead and the print media. However, any variation in the parallelism between the path of the printhead nozzle plate and the plane of the platen results in variations in the printhead to print media gap along the extent of the print zone.

What is needed in the art is a platen system for an imaging apparatus that provides for a substantially uniform printhead to platen gap throughout the print zone, which in turn provides for a substantially uniform printhead to print media gap throughout the print zone.

SUMMARY OF THE INVENTION

The present invention provides a platen system for an imaging apparatus that provides for a substantially uniform printhead to platen gap throughout the print zone, which in turn provides for a substantially uniform printhead to print media gap throughout the print zone.

The invention comprises, in one form thereof, an imaging apparatus providing a machine frame including a first side frame and a second side frame, wherein the first side frame is spaced apart from the second side frame. A first plurality of platen mounting members is provided which are spaced apart and extend from the first side frame. A second plurality of platen mounting members is provided which are spaced apart and extend from the second side frame. A platen is positioned to extend between the first side frame and the second side frame. The platen has a first end including a first plurality of engagement members and has a second end including a second plurality of engagement members. A biasing assembly is coupled to the machine frame, wherein the biasing assembly applies a biasing force to the platen to move the first plurality of engagement members into respective engagement with the first plurality of platen mounting members and to move the second plurality of engagement members into respective engagement with the second plurality of platen mounting members.

An advantage of the present invention is that the platen is biased in relation to features precisely located on the side frames of the imaging apparatus, thereby providing for the accurate placement of the platen in relation to a printhead.

Another advantage is that the platen is deflectable to ease the clearing of any media sheet jams.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
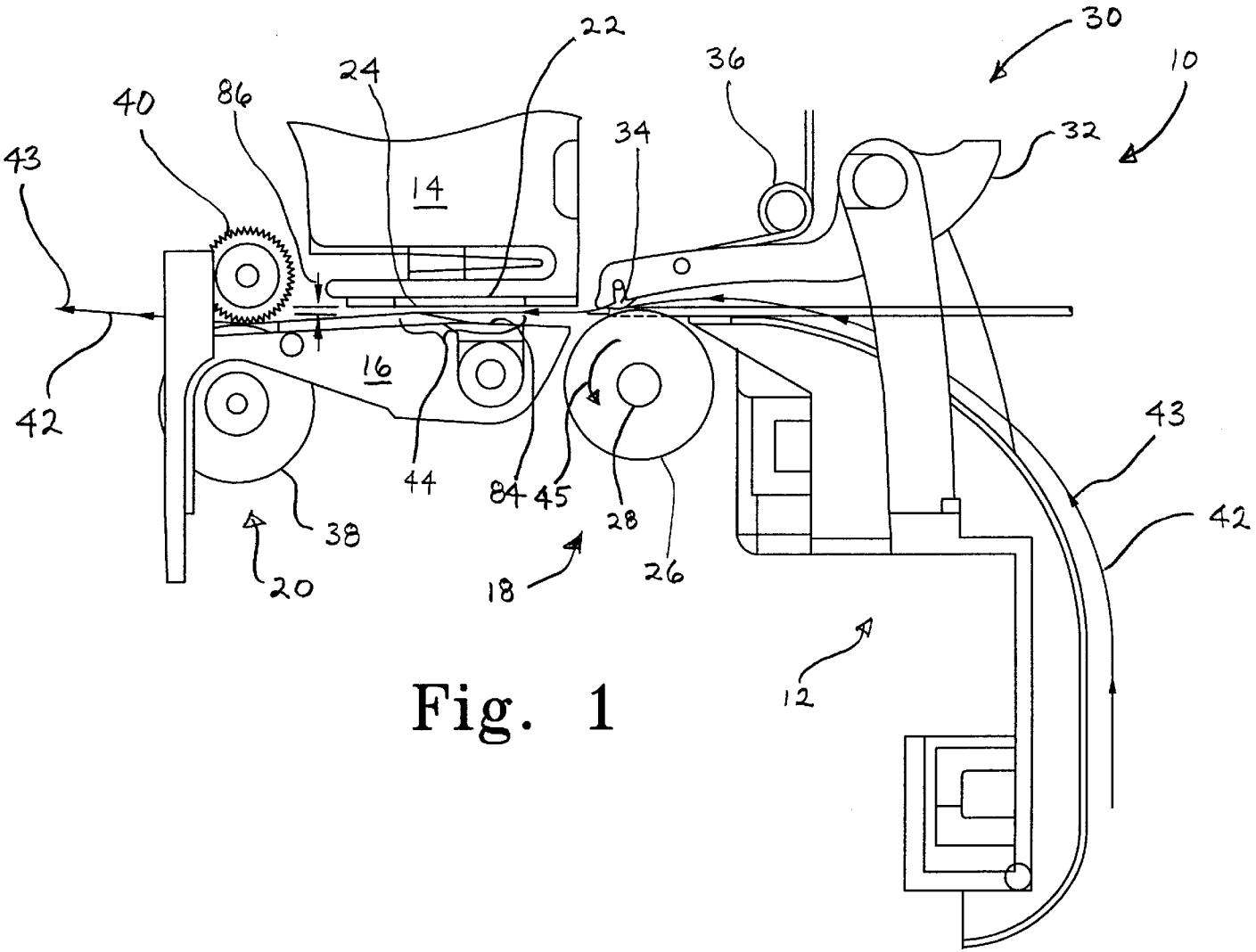
FIG. 1 is a schematic side view of an ink jet printer embodying the invention.

Referring now to the drawings and particularly to FIG. 1, there is shown an imaging apparatus in the form of an ink jet printer 10. Ink jet printer 10 includes a machine frame 12, a printhead cartridge 14, a platen 16, a feed roller assembly 18 and an exit roller assembly 20. Printhead cartridge 14 is carried by a printhead carriage drive system (not shown) in a reciprocating manner as is well known in the art. Printhead cartridge 14 includes a printhead 22 having a surface including a nozzle plate 24 containing a plurality of nozzles for controllably expelling ink droplets onto a sheet of print media.

Feed roller assembly 18 includes a feed roller 26, a feed roller shaft 28, and a back-up roller assembly 30. Feed roller 26 is mounted on feed roller shaft 28 for cooperative rotation therewith. Feed roller shaft 28 is rotatably mounted to frame 12 via bearings (not shown). Back-up roller assembly 30 includes a lever 32 pivotally coupled to frame 12, a plurality of back-up rollers 34 rotatably coupled to lever 32 and a spring 36 for applying a force to press back-up rollers 34 toward feed roller 26. Those skilled in the art will recognize that in practice feed roller 26 may be a single roller, or multiple rollers.

Exit roller assembly 20 includes an exit roller 38 and a plurality of star wheel rollers 40. Typically, exit roller 38 is a driven roller, and each of star wheel rollers 40 are spring loaded into contact with exit roller 38. Those skilled in the art will recognize that in practice exit roller 38 may be a single roller, or multiple rollers.

During a printing operation, print media is transported in a manner known in the art along a media path depicted by a line 42 in a media feed direction, as depicted by the arrows 43 of line 42, between feed roller 26 and back-up rollers 34 and past printhead 22. The bidirectional path traveled by printhead nozzle plate 24 defines a print zone 44 within which the transported sheet of print media will be printed. Feed roller assembly 18 incrementally indexes a sheet of print media past printhead nozzle plate 24 by rotating feed roller 26 and feed roller shaft 28 in the direction indicated by arrow 45, and exit roller assembly 20 receives the printed sheet between exit roller 38 and star wheel rollers 40 to advance the printed sheet out of ink jet printer 10.

Figure 2:
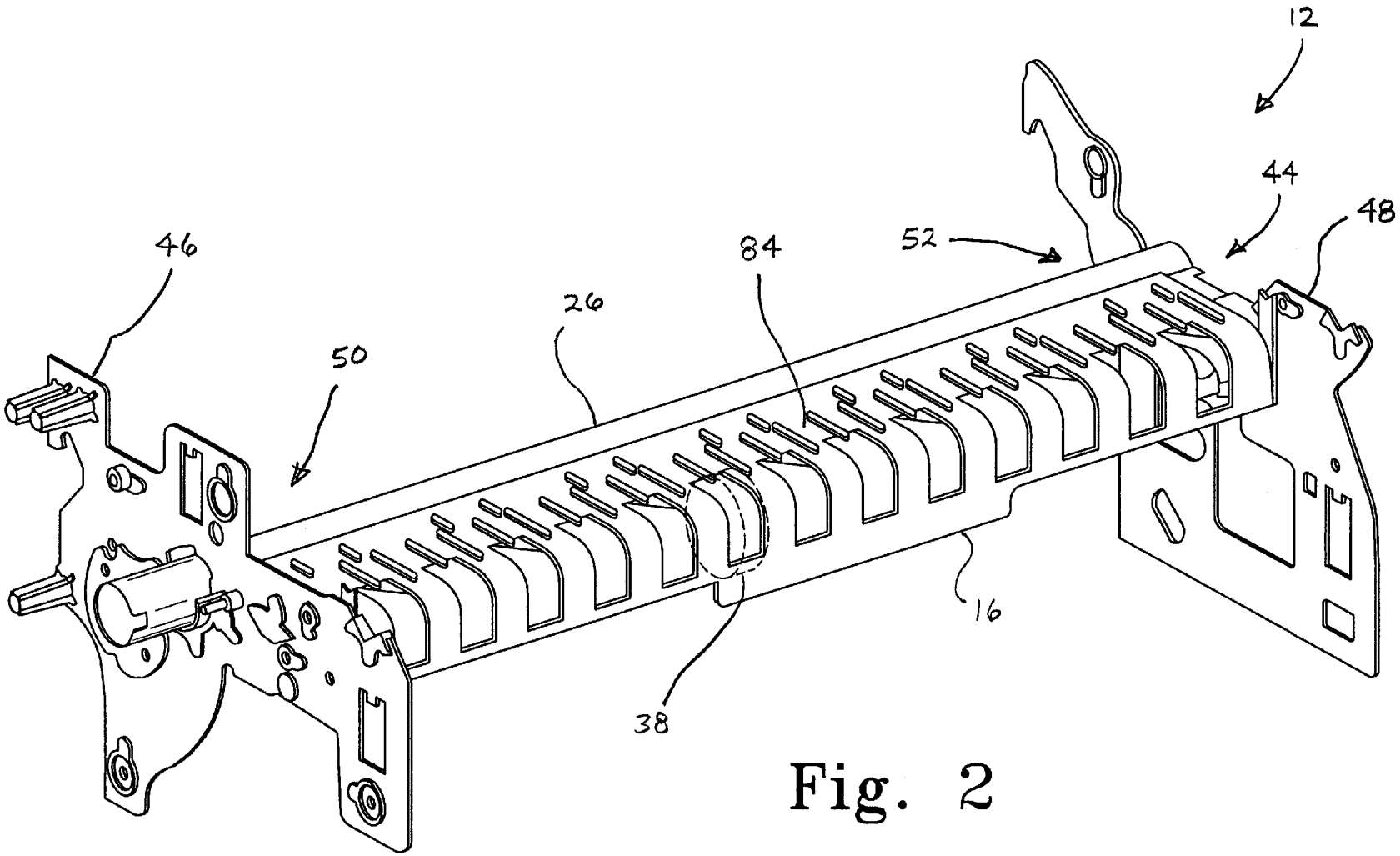
FIG. 2 is a perspective view of the platen and side frames of the invention.

As shown in FIG. 2, printer frame 12 includes a first side frame 46 and a second side frame 48. First and second side frames 46, 48 are positioned to be spaced apart, with platen 16 being interposed therebetween. A first end 50 of platen 16 is positioned adjacent first side frame 46 and a second end 52 of platen 16 is positioned adjacent second side frame 48.

Figure 3:
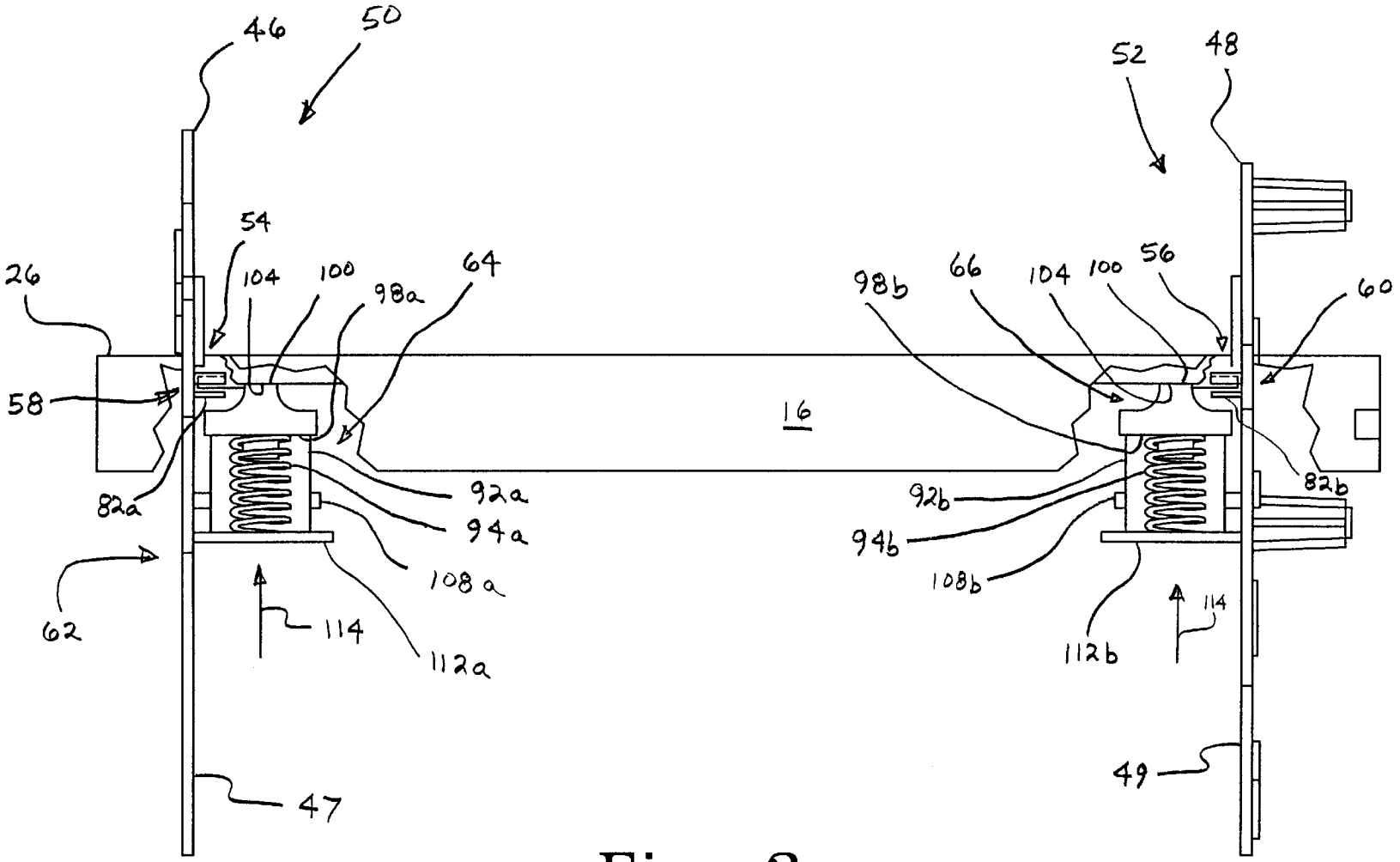
FIG. 3 is a front view of the platen of FIG. 2 having sections broken away to expose the platen biasing assembly of the invention.
Figure 4A:
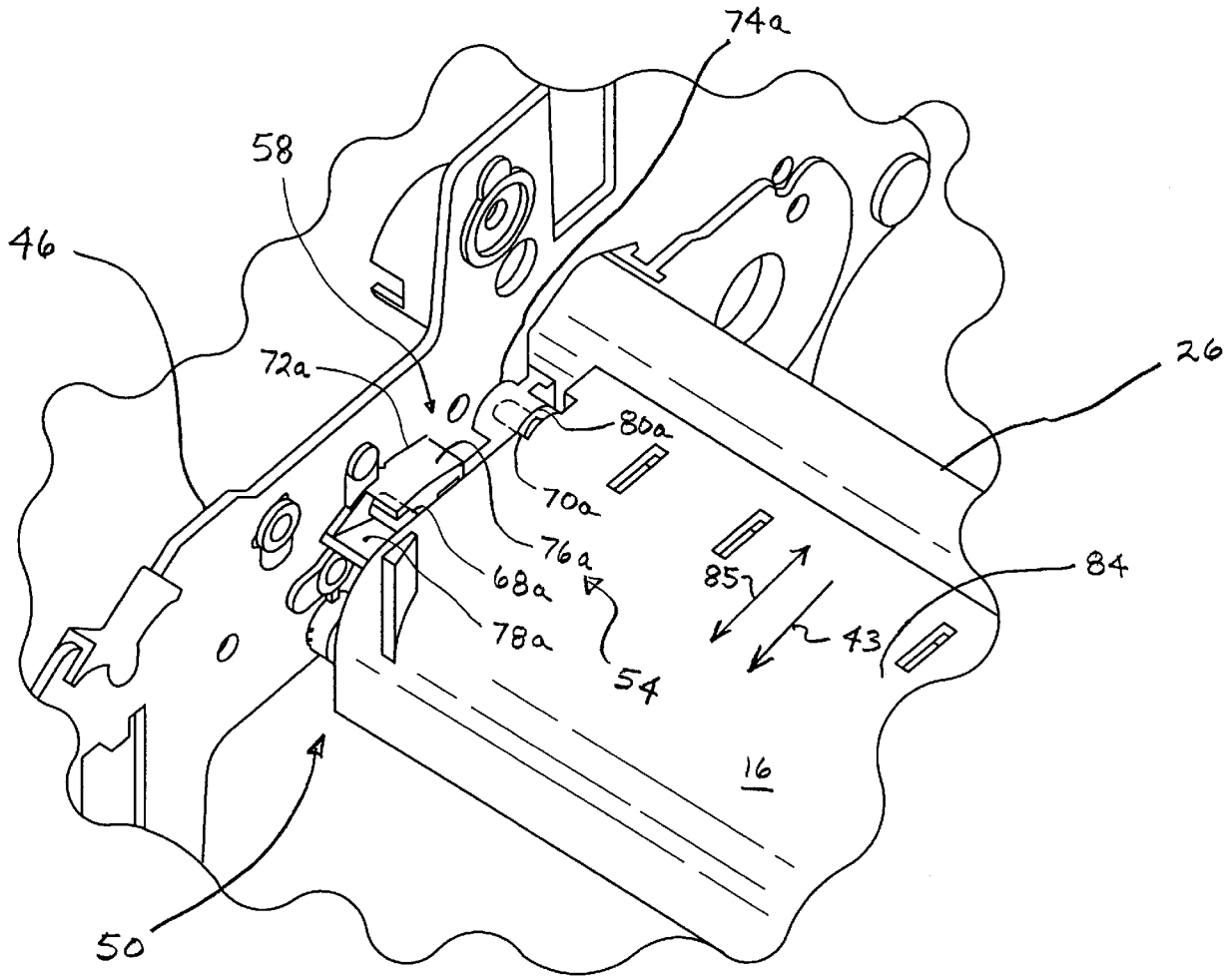
FIGS. 4A and 4B are partial perspective views of the end portions of the platen in mechanical communication with the respective machine side frames.
Figure 4B:
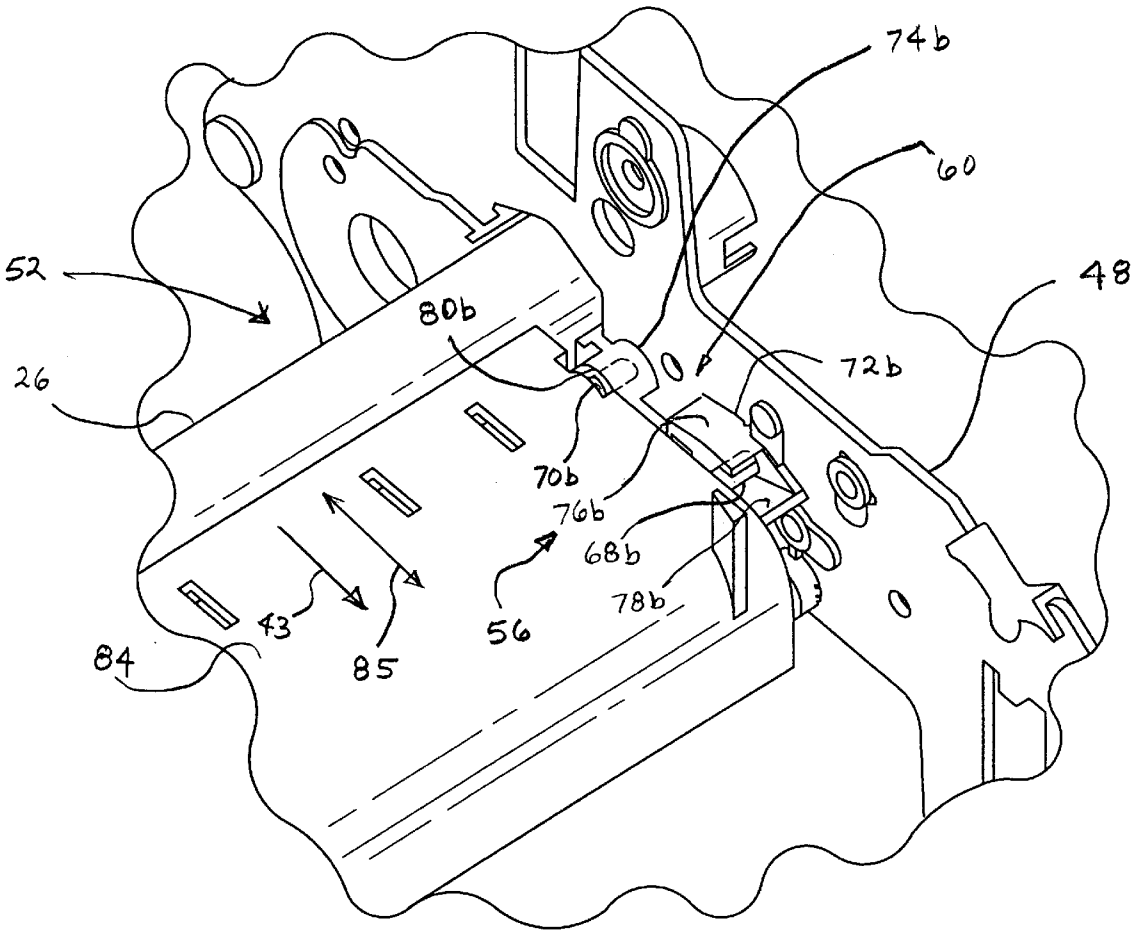

Referring to FIG. 3, a portion of each end of platen 16 is shown broken away to expose the platen mounting and biasing mechanisms of the invention. As shown in FIGS. 3, 4A and 4B, first end 50 of platen 16 includes a first plurality of engagement members 54 and second end 52 of platen 16 includes a second plurality of engagement members 56. A first plurality of platen mounting members 58 extend from first side frame 46, and a second plurality of platen mounting members 60 extend from second side frame 48.

Referring to FIG. 3, a platen biasing assembly 62 includes a first biasing unit 64 coupled to first side frame 46 and a second biasing unit 66 coupled to second side frame 48. Platen biasing assembly 62 applies a biasing force to platen 16 to move first plurality of engagement members 54 into respective engagement with first plurality of platen mounting members 58 and to move second plurality of engagement members 56 into respective engagement with second plurality of platen mounting members 60.

As shown in FIGS. 4A and 4B, in the preferred embodiment described herein, the positioning of engagement members 54 of platen 16 is symmetrical with respect to the positioning of engagement members 56 of platen 16. Similarly, the positioning of first plurality of platen mounting members 58 on first side frame 46 and the positioning of second plurality of platen mounting members 60 on second side frame 48 is such that the orientation of first plurality of platen mounting members 58 is a mirror image of the orientation of the orientation of the second plurality of platen mounting members 60. Accordingly, for the sake of brevity, sometimes only the structure of platen mounting members attached to first side frame 46 and the engagement members of first end 50 of platen 16 will be discussed in detail. It is to be understood, however, that functionally any discussion relating to first side frame 46 and first end 50 of platen 16 also applies to second side frame 48 and second end 52 of platen 16. While the preferred embodiment described herein utilizes a symmetrical arrangement of components, those skilled in the art will recognize that deviations from such symmetrical arrangement can be made without departing from the spirit and scope of the invention.

Likewise, biasing units 64, 66 are substantially identical. Accordingly, only the structure of-biasing unit 64 will be described in detail with respect to FIGS. 6 and 7. It is to be understood that any discussion relating to the structure of first biasing unit 64 also applies to second biasing unit 66.

Referring now to FIGS. 4A and 4B, first and second plurality of engagement members 54, 56 of platen 16 include a first dowel protrusion 68*a*, 68*b*, respectively, which is spaced apart and a second dowel protrusion 70*a*, 70*b*, respectively, in a direction corresponding to arrow 43. Correspondingly, first and second plurality of platen mounting members 58, 60 include a first slotted housing 72*a*, 72*b*, respectively, which is spaced apart from a second slotted housing 74*a*, 74*b*, respectively, in the direction corresponding to arrow 43.

Figure 5:
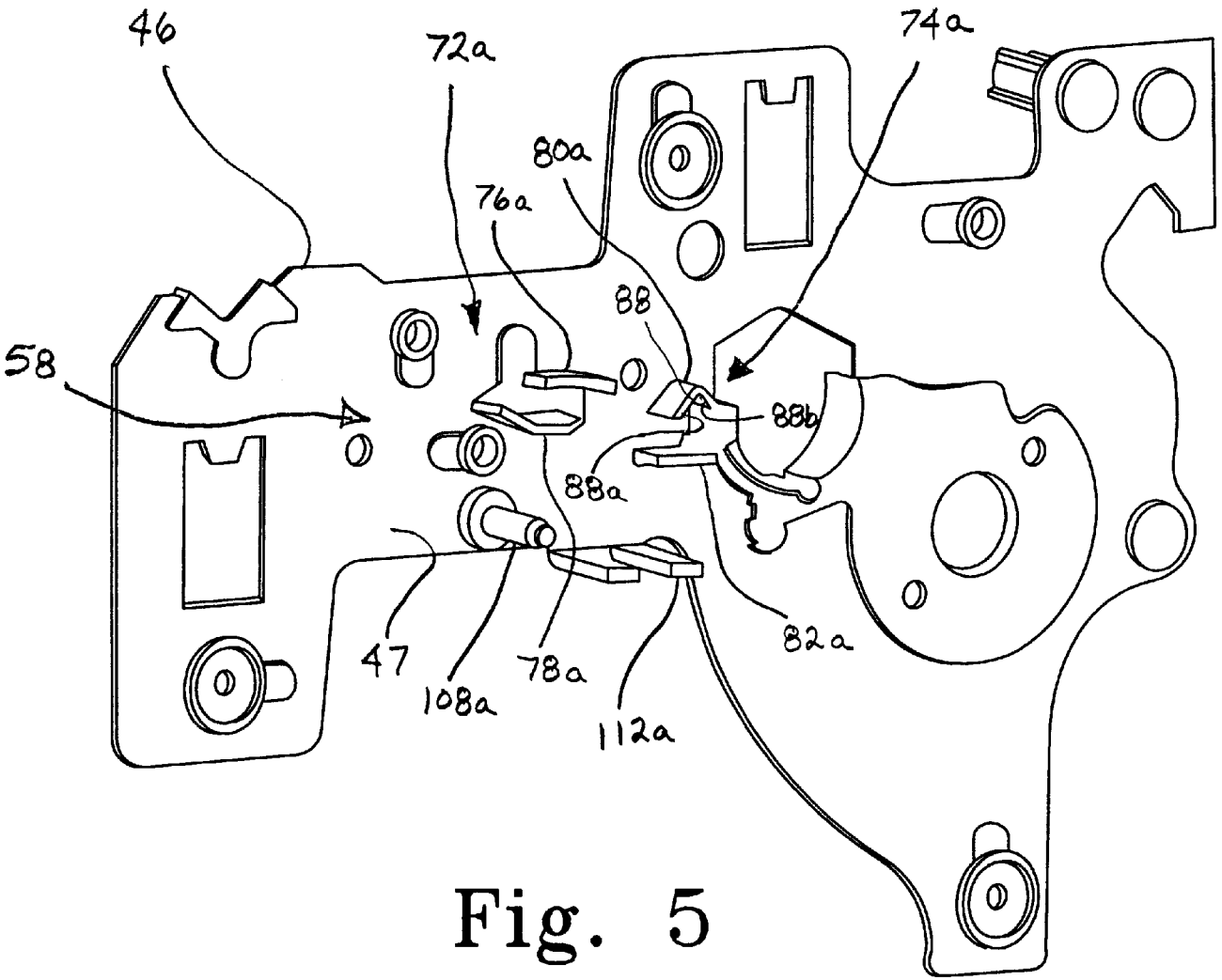
FIG. 5 is a perspective side view of one of the side frames including precisely located features for mounting the platen.

As shown in FIG. 5, attached to first side frame 46 is first slotted housing 72*a* which includes an upper retaining tab 76*a* and a first lower shelf 78*a*. Second slotted housing 74*a* includes a downwardly facing open-faced bearing structure 80*a* positioned above a second shelf 82*a*. Retaining tab 76*a* and first lower shelf 78*a* are positioned to define an opening for receiving dowel protrusion 68*a*, and open-faced bearing structure 80*a* and second shelf 82*a* are positioned to define an opening for receiving dowel protrusion 70*a*. Components 76*b*, 78*b*, 80*b* and 82*b* corresponding to components 76*a*, 78*a*, 80*a* and 82*a* are also located on second side frame 48, as can be seen in part in FIGS. 3 and 4B. Shelves 78*a*, 82*a* and 78*b*, 82*b* serve to facilitate assembly of platen 16 within the confines of first and second side frame 46, 48 by providing pairs of resting surfaces which support dowel protrusions 68*a*, 70*a* and 68*b*, 70*b*, respectively.

Each of upper retaining tabs 76*a*, 76*b* and open-faced bearing structures 80*a*, 80*b* of side frames 46, 48 define the upper limits of travel of dowel protrusions 68*a*, 68*b*, 70*a*, 70*b*, respectively, of platen 16, and accordingly, define an upper limit of travel of platen surface 84 in print zone 44. In addition, open-faced bearing structures 80*a*, 80*b* are configured to position dowel protrusions 70*a*, 70*b* in the directions indicated by the arrows of line 85, wherein line 85 lies in a plane parallel to the plane of line 43 depicting the direction of media travel. Accordingly, referring to FIGS. 1, 2, 4A and 4B, first plurality of platen mounting members 58 and second plurality of platen mounting members 60 are positioned to define a height of a gap 86 between platen 16, i.e., platen surface 84 and printhead nozzle plate 24 in print zone 44.

Figure 6:
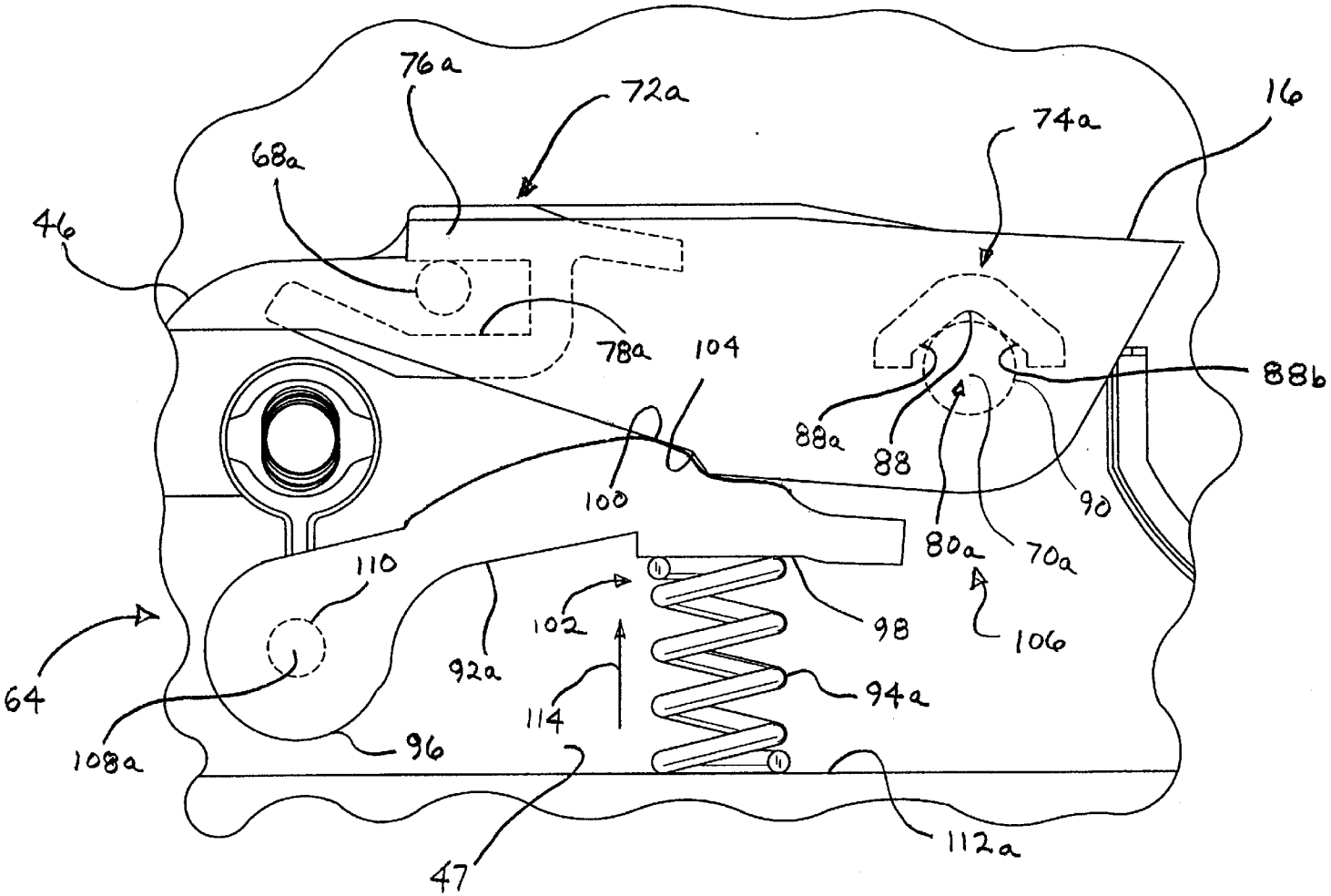
FIG. 6 is a partial side view of one of the platen biasing units that comprises the platen biasing assembly.

As most clearly shown with reference to FIGS. 5 and 6, the open-faced bearing structure of each of bearing structures 80*a*, 80*b* defines a bearing surface 88 having at least two separated regions 88*a*, 88*b* for contacting a surface 90 of each of dowel protrusion 70*a*, 70*b*, respectively. Preferably, bearing surface 88 is configured in a V-shape, with the open portion of the V facing downwardly.

Figure 7:
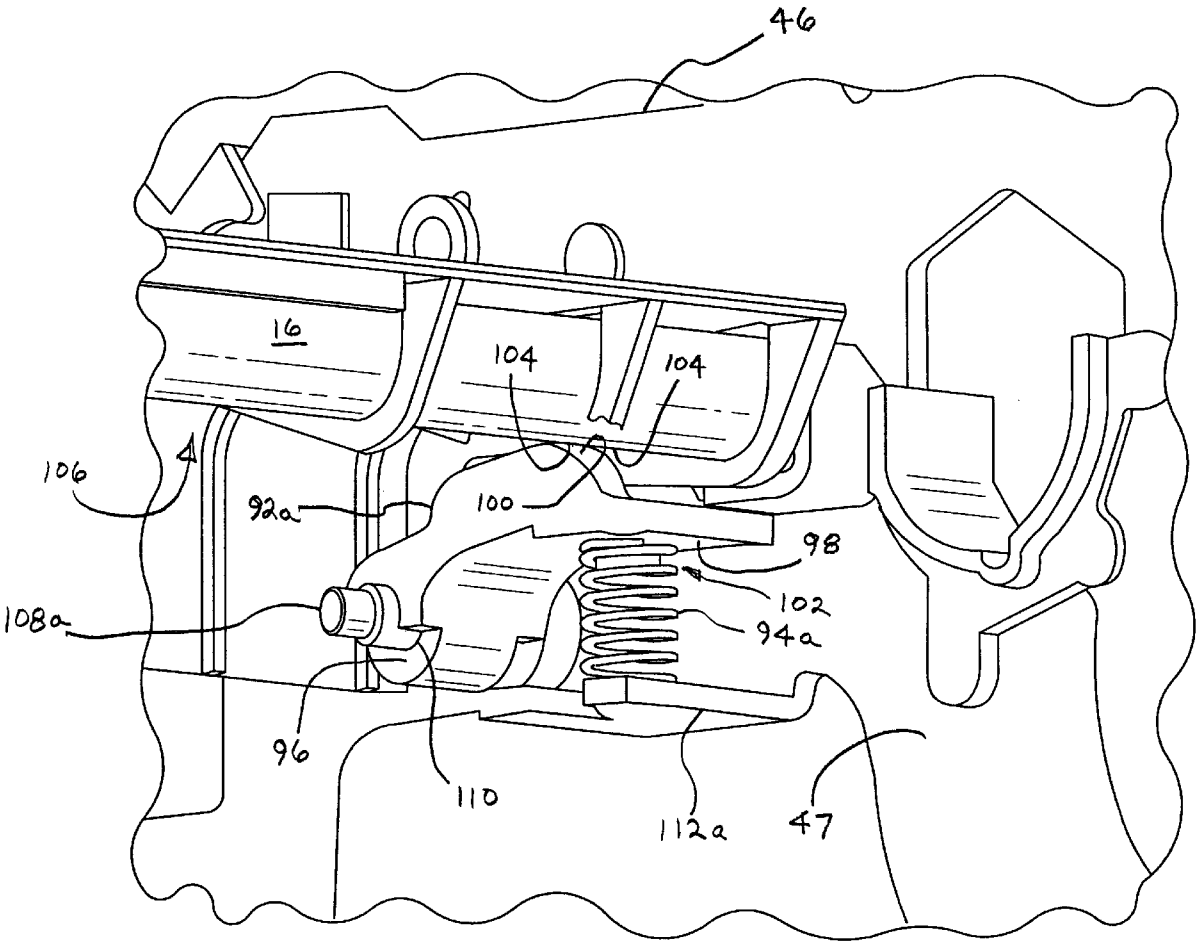
FIG. 7 is a partial perspective view of one of the platen biasing units engaging the platen.

Referring now to FIGS. 3, 6 and 7, each of biasing units 64, 66 include an elongate member 92*a*, 92*b* and a spring 94*a*, 94*b* respectively, which are supportably coupled to corresponding side frames 46, 48. As shown with respect to side frame 46, elongate member 92*a* includes a pivot portion 96, a spring contact surface 98, and a biasing surface 100. Spring contact surface 98 is located to contact an upper portion 102 of spring 94*a*. Biasing surface 100 is positioned to engage a contact surface 104 on the under side 106 of platen 16.

Pivotal support for each of elongate members 92*a*, 92*b* is provided by a pivot axle 108*a*, 108*b*, respectively, (see FIG. 3) that extends outwardly from the plane surface 47, 49 of first side frame 46 and second side frame 48, respectively. As best shown in FIGS. 6 and 7, pivot axle 108*a* is received in a pivot hole 110 of elongate member 92*a*. The lower support for spring 94*a* is provided by a spring shelf 112*a* that extends outwardly from first side frame 46. Likewise, lower support for spring 94*b* is provided by a spring shelf 112*b* that extends outwardly from second side frame 48. Accordingly, spring 94*a* is coupled between side frame 46 and spring contact surface 98*a* of elongate member 92*a*, and spring 94*a* is coupled between side frame 48 and spring contact surface 98*b* of elongate member 92*b*, to apply a biasing force generally in the direction indicated by arrow 114 to move biasing surface 100 into contact with contact surface 104 of platen 16.

Preferably, each of first side frame 46 and second side frame 48 are formed substantially from metal, and each of the first and second pluralities of mounting members 58, 60; pivot axles 108*a*, 108*b* and spring shelves 112*a*, 112*b* are made of a high strength wear-resistant plastic, such as a thermoplastic polyester resin. In order to precisely position the components 58, 60, 108*a*, 108*b*, 112*a*, 112*b* with respect to the metal portion of the respective side frame 46, 48, the components are over-molded onto the metal portion during fabrication of the respective side frame 46, 48.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a machine frame including a first side frame and a second side frame, said first side frame being spaced apart from said second side frame;

a first plurality of platen mounting members which are spaced apart and extend from said first side frame;

a second plurality of platen mounting members which are spaced apart and extend from said second side frame;

a platen positioned to extend between said first side frame and said second side frame, said platen having a first end including a first plurality of engagement members and having a second end including a second plurality of engagement members; and a biasing assembly coupled to said machine frame, wherein said biasing assembly applies a biasing force to said platen to move said first plurality of engagement members into respective engagement with said first plurality of platen mounting members and to move said second plurality of engagement members into respective engagement with said second plurality of platen mounting members.

2. The imaging apparatus of claim 1, wherein at least one member of said first plurality of platen mounting members comprises a first open-faced bearing structure defining a first bearing surface having at least two separated regions which contact a corresponding one of said first plurality of engagement members, and wherein at least one member of said second plurality of platen mounting members comprises a second open-faced bearing structure defining a second bearing surface having at least two separated regions which contact a corresponding one of said second plurality of engagement members.

3. The imaging apparatus of claim 2, wherein at least one of said first bearing surface and said second bearing surface is configured in a V-shape.

4. The imaging apparatus of claim 2, wherein an open region of each of said first open-faced bearing structure and said second open-faced bearing structure is positioned to face downwardly.

5. The imaging apparatus of claim 1, further comprising a printhead, and wherein said first plurality of platen mounting members and said second plurality of platen mounting members are positioned to define a height of a gap between said platen and said printhead.

6. The imaging apparatus of claim 1, wherein said biasing assembly comprises:

an elongate member having a biasing surface, said elongate member being pivotably coupled to said machine frame; and a spring coupled between said machine frame and said elongate member to apply said biasing force to move said biasing surface into contact with said platen.

7. The imaging apparatus of claim 6, wherein said platen is moved in a generally upward direction by said biasing force.

8. The imaging apparatus of claim 1, wherein said biasing assembly comprises:

a first elongate member having a first biasing surface, said first elongate member being pivotably coupled to said first side frame;

a second elongate member having a second biasing surface, said second elongate member being pivotably coupled to said second side frame;

a first spring coupled between said machine frame and said first elongate member to force said first biasing surface into contact with said platen near said first end of said platen; and a second spring coupled between said machine frame and said second elongate member to force said second biasing surface into contact with said platen near said second end of said platen.

9. The imaging apparatus of claim 1, wherein each of said first side frame and said second side frame are formed substantially from metal, and wherein each of said first plurality of spaced apart mounting members and said second plurality of spaced apart mounting members are made of a wear-resistant plastic.

10. The imaging apparatus of claim 9, wherein said first plurality of platen mounting members and said second plurality of platen mounting members are over-molded onto said first side frame and said second side frame, respectively.

11. An ink jet printer, comprising:

a machine frame including a first side frame and a second side frame, said first side frame being spaced apart from said second side frame;

a printhead coupled to said machine frame;

a first plurality of platen mounting members which are spaced apart and extend from said first side frame;

a second plurality of platen mounting members which are spaced apart and extend from said second side frame;

a platen positioned to extend between said first side frame and said second side frame, said platen having a first end including a first plurality of engagement members and having a second end including a second plurality of engagement members; and a biasing assembly coupled to said machine frame, wherein said biasing assembly applies a biasing force to said platen to move said first plurality of engagement members into respective engagement with said first plurality of platen mounting members and to move said second plurality of engagement members into respective engagement with said second plurality of platen mounting members.

12. The ink jet printer of claim 11, wherein at least one member of said first plurality of platen mounting members comprises a first open-faced bearing structure defining a first bearing surface having at least two separated regions which contact a corresponding one of said first plurality of engagement members, and wherein at least one member of said second plurality of platen mounting members comprises a second open-faced bearing structure defining a second bearing surface having at least two separated regions which contact a corresponding one of said second plurality of engagement members.

13. The ink jet printer of claim 12, wherein at least one of said first bearing surface and said second bearing surface is configured in a V-shape.

14. The ink jet printer of claim 12, wherein an open region of each of said first open-faced bearing structure and said second open-faced bearing structure is positioned to face downwardly.

15. The ink jet printer of claim 11, wherein said first plurality of platen mounting members and said second plurality of platen mounting members are positioned to define a height of a gap between said platen and said printhead.

16. The ink jet printer of claim 11, wherein said biasing assembly comprises:

an elongate member having a biasing surface, said elongate member being pivotably coupled to said machine frame; and a spring coupled between said machine frame and said elongate member to apply said biasing force to move said biasing surface into contact with said platen.

17. The ink jet printer of claim 16, wherein said platen is moved in a generally upward direction by said biasing force.

18. The ink jet printer of claim 11, wherein said biasing assembly comprises:

a first elongate member having a first biasing surface, said first elongate member being pivotably coupled to said first side frame;

a second elongate member having a second biasing surface, said second elongate member being pivotably coupled to said second side frame;

a first spring coupled between said machine frame and said first elongate member to force said first biasing surface into contact with said platen near said first end of said platen; and a second spring coupled between said machine frame and said second elongate member to force said second biasing surface into contact with said platen near said second end of said platen.

19. The ink jet printer of claim 11, wherein each of said first side frame and said second side frame are formed substantially from metal, and wherein each of said first plurality of spaced apart mounting members and said second plurality of spaced apart mounting members are made of a wear-resistant plastic.

20. The ink jet printer of claim 19, wherein said first plurality of platen mounting members and said second plurality of platen mounting members are overmolded onto said first side frame and said second side frame, respectively.

* * * * *